United States Patent [19]

Wakayama

[11] 4,268,819

[45] May 19, 1981

[54] SYNCHRO MOTOR TYPE INSTRUMENT

[75] Inventor: Masashi Wakayama, Kamisatomachi, Japan

[73] Assignee: Tamagawa Seiki Kabushiki Kaisha, Tokyo, Japan

[21] Appl. No.: 36,026

[22] Filed: May 4, 1979

[30] Foreign Application Priority Data

May 15, 1978 [JP] Japan ..... 53/63915[U]

[51] Int. Cl.[3] ..... G08C 19/00

[52] U.S. Cl. ..... 340/870.34

[58] Field of Search ..... 340/198, 347 SY; 318/560, 622, 608

[56] References Cited

U.S. PATENT DOCUMENTS 2,418,193 4/1947 Peterson ..... 340/198

3,307,165 2/1967 Sharp et al. ..... 340/198

*Primary Examiner*—Thomas A. Robinson

*Attorney, Agent, or Firm*—Wenderoth, Lind & Ponack

[57] ABSTRACT

A synchro receiver of the instrument according to this invention has a stator upon which a three-phase winding is wound and a rotor which forms a flat plate and has two magnetic poles made of high permeability material without an exciting winding thereby to spare the space in the instrument and to improve not only the vibration-proof and the reliability thereof but also assembling work.

2 Claims, 8 Drawing Figures

PRIOR ART

SYNCHRO MOTOR TYPE INSTRUMENT

BACKGROUND OF THE INVENTION

This invention relates to a synchro motor type instrument, and more particularly to an indicator in which an automatic return member and a needle are directly connected to a rotor of a synchro receiver to thereby make the needle return to the predetermined OFF position when synchro signal is not applied by a synchro transmitter.

A typical connection diagram of an ordinary synchro motor system is shown in FIG. 1, wherein a synchro transmitter 2 and a synchro receiver 3 are mutually and electrically combined with the three-phase windings 2*b*1, 2*b*2, and 2*b*3 of a stator 2*b* 3 being connected to the corresponding three-phase windings 3*b*1, 3*b*2, and 3*b*3 of a stator 3*b*. On the other hand, single-phase windings 2*a*1 and 3*a*1 which are respectively wound on rotors 2*a* and 3*a* are connected in parallel to each other and are excited by single-phase AC power source E through brushes (not shown) and sliprings (not shown), whereby an induced voltage is generated on the three-phase windings 3*b*1–3*b*3 of the stator 3*b* of the synchro receiver 3. An AC signal is also present on the three-phase transmitter windings 2*b*1–2*b*3.

In the case when the rotational angle position of the synchro transmitter 2 is fully equal to that of the synchro receiver 3, the induced voltages of the synchro transmitter 2 and the synchro receiver 3 are equal, and accordingly electric current does not flow between the mutual three-phase windings 2*b*1–2*b*3 and 3*b*1–3*b*3. Consequently, torque is not generated in the synchro receiver 3. But, when the rotor 2*a* of the synchro transmitter 2 is rotated by a certain angle in response to a load, a difference is produced in the angle of rotation between the synchro transmitter 2 and the synchro receiver 3, both of the induced voltages becoming unbalanced. Accordingly, electric current flows between the three-phase windings, and the rotor 3*a* of the synchro receiver 3 follows the rotor 2*a* of the synchro transmitter 2 and rotates to the same rotational angle as the rotor 2*a*, the electric current generating such a torque as to return the rotor 3*a* to its synchronous position. By using this torque, the aforementioned system operates a needle to perform as a remote angle transmission.

Nowadays, although synchro motor type aero-instruments which work by receiving the above-mentioned synchro signal are widely used, such apparatus have the following defects when used for the design of a small-vertical type aero-instrument. That is, inasmuch as it is required that the width be small, as illustrated in FIG. 2, for the appearance of a small-vertical type instrument, an included synchro motor 10 must be a pancake-type synchro motor which is short in an axial direction so as to be suitable for the space in the housing. However, since it is difficult to modify the shape of a conventional type synchro motor to that of a pancake-type shape, synchro motor type small-vertical instruments have rarely been used.

Furthermore, techniques have been tried to mount a small synchro motor for aircraft to a vertical instrument. That is, referring to FIG. 3, the bracket motor of the small synchro motor 10*c* is clamped to the mounting plate 10*d* in the housing 10*b* with a pair of screws 10*e*. Then, when adjusting the needle 10*f* to the synchro zero-position, an operator takes off housing 10*b* and loosens screws 10*e* to move the indicator plate 10*d* so as to adjust the zero-position of the needle 10*f*. Thus, it was difficult to adjust the zero-position the needle from outside of the instrument housing.

SUMMARY OF THE INVENTION

Accordingly, it is an object of this invention to provide a synchro motor type vertical instrument wherein a synchro receiver comprises a stator upon which a three-phase winding is wound and a rotor which has two magnetic poles made a high permeability material and does not have an exciting winding. As a result of such a design, there is no necessity of using a brush and slipring combination as required in the usual synchro motors, thereby reducing the length of the motor in the axial direction, and also more effectively utilizing the space within the instrument housing.

Another object of this invention is to provide a synchro motor type instrument wherein a needle has been mounted on the windingless rotor and an automatic return mechanism such as a spring has been provided to thereby return the needle to an OFF position when no synchro signal is inputted. This eliminates previously prevalent dangerous situations, such as erroneous indications due to the fact that if no synchro signal is inputted in the conventional instrument, the needle continues to point to the previous value.

DETAILED DESCRIPTION OF THE PREFERRED EMBODIMENT

Figure 1:
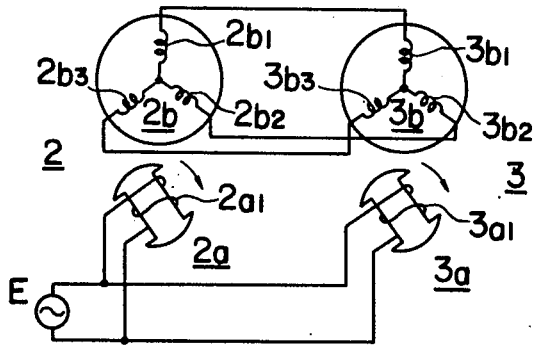
FIG. 1 is a connection diagram of an ordinary synchro motor system.
Figure 2:
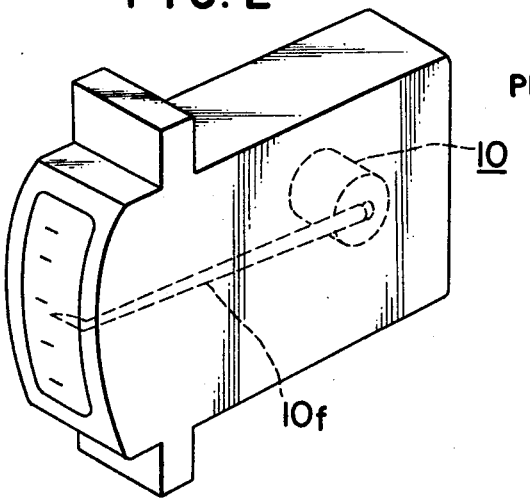
PRIOR ART FIG. 2
FIG. 2 is a schematic representation of a usual synchro motor type instrument.
Figure 3:
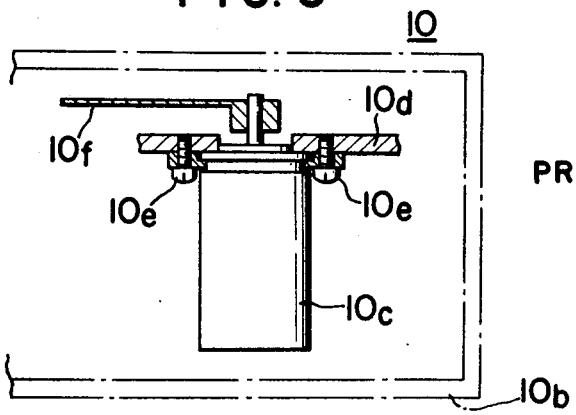
PRIOR ART FIG. 3
FIG. 3 is a fragmentary sectional view of a synchro type instrument applied to the vertical type indicator
Figure 4:
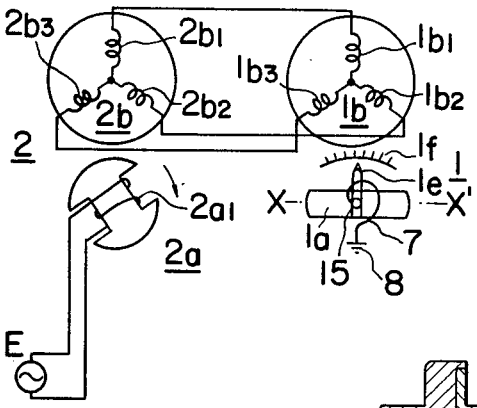
FIG. 4 is a connection diagram of the synchro motor system according to this invention.

FIG. 4 is similar to FIG. 1 with respect to the connection of the three-phase windings 1*b*1, 1*b*2 and 1*b*3 of the stator 1*b* of the synchro receiver 1 to the three-phase windings 2*b*1, 2*b*2 and 2*b*3 of a stator 2*b* of the synchro transmitter 2. Since a rotor of the synchro receiver 1 according to this invention forms a flat plate and is provided with no winding, only the single-phase winding 2*a*1 of a rotor 2*a* of the synchro transmitter 2 is excited by a single-phase AC power source E. The above-mentioned rotative plate is shown as the rotor 1*a* in FIG. 4.

The single-phase winding 2*a*1 is excited by the single-phase AC power source E as in the conventional case described above, and an induced voltage is generated at the three-phase windings 2*b*1, 2*b*2 and 2*b*3 of the stator 2*b* of the synchro transmitter 2. As a result, the electric current flows in the three-phase windings 1*b*1, 1*b*2 and 1b3 of the stator 1b of the synchro receiver 1, and the magnetic flux generated in this way forms a magnetic path through the rotor 1a made of high permeability material. It should be noted that a torque is generated at the rotor 1a so as to reduce the magnetic resistance of the magnetic path to the minimum, thereby to move the rotor1a to a position corresponding to the reference position of the rotor 2a, as indicated by the needle 1e.

Figure 8:
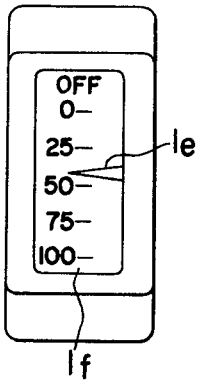
FIG. 8 is a front elevation of the scale portion of the synchro motor type instrument according to this invention.

When a variation which corresponds to the load is applied to the rotor 2a of the synchro transmitter 2, the induced voltage of the three-phase windings 2b1, 2b2 and 2b3 of the stator 2b changes to cause unbalance in the voltage between the three-phase windings 1b1, 1b2 and 1b3 of the synchro receiver 1 and that of the synchro transmitter 2 and causes an electric current to flow which produces a torque on the rotor 1. Since this torque operates to reduce the magnetic resistance to a minimum, the rotor 1a synchronously stops at the position where the direction of the magnetic flux generated at the stator 1b is identical with that of the center line X–X' of the rotor 1a, to thereby indicate the new position of the needle 1e on the scale 1f. The mechanical structure of the synchro motor type instrument according to this invention is shown in FIGS. 5 and 6, and a view of this indication is illustrated in FIG. 8.

Figure 5:
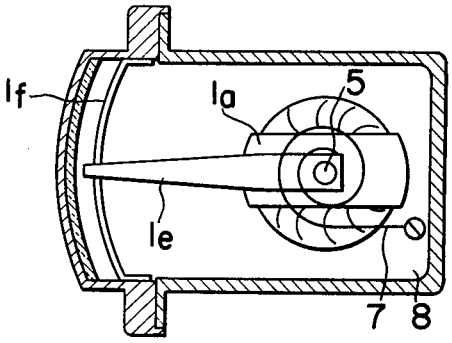
FIG. 5 is a transverse sectional view of the synchro motor type instrument according to this invention.
Figure 6:
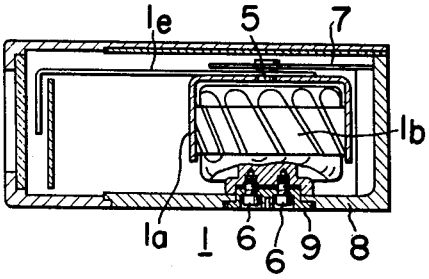
FIG. 6 is a longitudinal sectional view of the synchro motor type instrument according to this invention.
Figure 7:
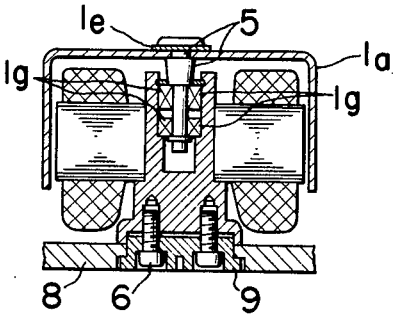
FIG. 7 is a longitudinal sectional view of the synchro receiver according to this invention.

As shown in FIGS. 5–7, the needle 1e and an axle 5 are integrally mounted to the rotor 1a and these members are pivotably carried by a bearing 1g. Further, one end portion of a spring 7 is attached to the axle 5, and the other portion thereof is attached to the housing 8 of the synchro receiver 1. As a result, when the synchro signal is not applied to the synchro receiver 1, the needle 1e returns to the OFF position (refer to FIG. 8) of the scale 1f by means of the returning force of the spring 7. The elements 6 are attachment screws for the synchro motor system which are mounted at the housing 8. It is possible to easily adjust the zero-position of the needle 1e from outside of the instrument, by just loosening the attachment screws 6 and slightly rotating the attachment member 9.

From the above descriptions, it is apparent that if the rotor 1a of the synchro receiver 1 according to this invention is constructed so as to have a rotative plate of the rectangular form and magnetic poles made of high permeability material, the rotor 1a of the synchro receiver 1 can rotate in synchronism with the rotor 2a of the synchro transmitter 2 without an exciting winding to thereby provide full operation as a synchro motor machine.

Moreover, inasmuch as it is possible to omit the windings of the rotor which are conventionally used in the usual synchro motor, brushes, and sliprings become unnecessary to thereby reduce the space necessary for the instrument and to remarkably improve the vibration-proof characteristics and the reliability of the instrument.

Further, such a simple structure causes not only an improvement in its assembly, but also causes a reduction in the manufacturing cost thereof.

Still further, the omission of the rotor winding causes an improvement in the degree of heat emission of the synchro receiver. Normally, the synchro motor type instrument according to this invention has a problem in that there are two stable positions, namely 0° and 180° during one rotation in the synchro motor system. However, since the useable range of angles is automatically limited by the spring 7 when the vertical type synchro motor type instrument, as shown in FIGS. 5 and 8, is used, the above-mentioned problem can be overcome to thereby exhibit true merits for the high reliability aero-instrument and the like.

What is claimed is:

1. A synchro motor instrument comprising:

a synchro transmitter including a stator having a first three-phase AC winding and a rotor having a single phase AC winding;

a synchro receiver including a stator having a second three-phase AC winding and a rotor having two magnetic poles, said rotor fabricated of a high permeability material;

said rotor of said synchro receiver further including a needle and an automatic return means attached thereto, said needle having a predetermined OFF position;

said first and second three-phase AC windings connected together, wherein when said transmitter rotor is displaced by a specific rotational angle, AC currents flow between said first and second three-phase AC windings to thereby cause a torque to be exerted on said synchro receiver rotor, whereby said receiver rotor and said needle attached thereto rotate an angle equal to said specific rotational angle, providing that said rotor of said synchro transmitter is provided with a single phase AC excitation signal;

and wherein said automatic return means causes said receiver rotor and said needle attached thereto to rotate to said predetermined OFF position of said needle in the absence of the providing of said single phase AC excitation signal to said synchro transmitter rotor.

2. A synchro motor instrument as in claim 1, wherein said synchro receiver comprises a pancake type motor having a flat pancake type rotor.

* * * * *